US010933656B2

(12) United States Patent
Fujita

(10) Patent No.: US 10,933,656 B2
(45) Date of Patent: Mar. 2, 2021

(54) PRINTING SYSTEM

(71) Applicant: Brother Kogyo Kabushiki Kaisha, Nagoya (JP)

(72) Inventor: Keisuke Fujita, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/669,806

(22) Filed: Oct. 31, 2019

(65) Prior Publication Data

US 2020/0130367 A1 Apr. 30, 2020

(30) Foreign Application Priority Data

Oct. 31, 2018 (JP) ..... JP2018-205916

(51) Int. Cl.

| | |
|---|---|
| ***B41J 2/325*** | (2006.01) |
| ***B41J 32/00*** | (2006.01) |
| ***B41J 33/56*** | (2006.01) |
| ***B41J 33/14*** | (2006.01) |

(52) U.S. Cl.

CPC ..... *B41J 2/325* (2013.01); *B41J 32/00* (2013.01); *B41J 33/14* (2013.01); *B41J 33/56* (2013.01)

(58) Field of Classification Search

CPC ... B41J 2/325; B41J 2/355; B41J 29/38; B41J 2/32; B41J 33/24; B41J 2202/33; B41J 33/14; B41J 32/00; B41J 33/56

See application file for complete search history.

(56) References Cited

U.S. PATENT DOCUMENTS

| | | | |
|---|---|---|---|
| 5,691,961 | A | 11/1997 | Paranjpe |
| 6,313,860 | B1 | 11/2001 | Suzuki et al. |
| 2007/0172290 | A1 | 7/2007 | Nagae et al. |
| 2010/0166475 | A1 | 7/2010 | Yamaguchi et al. |

(Continued)

FOREIGN PATENT DOCUMENTS

| | | | |
|---|---|---|---|
| CN | 1951701 | A | 4/2007 |
| CN | 101038633 | A | 9/2007 |

(Continued)

OTHER PUBLICATIONS

Sep. 17, 2020—(CN) Office Action—App 201911029240.3, Eng Iran X.

Apr. 30, 2020—(EP) Extended Search Report—App 19205712.3.

*Primary Examiner* — Jannelle M Lebron

(74) *Attorney, Agent, or Firm* — Banner & Witcoff, Ltd.

(57) ABSTRACT

A printing system includes: a movable printing device; a control unit; and a device moving unit that is configured to move the movable printing device, the movable printing device includes a thermal head and a ribbon transport unit, the control unit is configured to: execute print operation control including: device position control; ribbon transport control; and head print control; execute, when a print stop command is received, print stop control; execute, when a print resume command is received after a start of execution of the print stop control, the print resume control, and execute, when predetermined information is received after the start of execution of the print stop control, reset control of causing the device moving unit to move the movable printing device to a reference position, causing the ribbon transport unit to transport the ink ribbon by a predetermined amount and then restarting the print operation control.

5 Claims, 8 Drawing Sheets

(56) References Cited

U.S. PATENT DOCUMENTS

| | | | | |
|---|---|---|---|---|
| 2014/0036019 | A1* | 2/2014 | Mori | B41J 2/325 347/197 |
| 2014/0292991 | A1* | 10/2014 | Aihara | B41J 2/325 347/214 |
| 2016/0288530 | A1 | 10/2016 | Kaneoya | |

FOREIGN PATENT DOCUMENTS

| | | | |
|---|---|---|---|
| CN | 103786451 | A | 5/2014 |
| CN | 106004073 | A | 10/2016 |
| JP | S61-248779 | A | 11/1986 |
| JP | H06-127091 | A | 5/1994 |
| JP | H08-267860 | A | 10/1996 |
| JP | 2000-103102 | A | 4/2000 |
| JP | 2001-030525 | A | 2/2001 |
| JP | 2001-047715 | A | 2/2001 |
| JP | 2002-052773 | A | 2/2002 |
| JP | 2003-127448 | A | 5/2003 |
| JP | 2004-216723 | A | 8/2004 |
| JP | 2008-044205 | A | 2/2008 |
| JP | 2009-067055 | A | 4/2009 |
| JP | 2009-096001 | A | 5/2009 |
| JP | 2012-066549 | A | 4/2012 |
| JP | 2014-046517 | A | 3/2014 |

* cited by examiner

PRINTING SYSTEM

CROSS-REFERENCE TO RELATED APPLICATION

This application claims priority from Japanese Patent Application No. 2018-205916 filed on Oct. 31, 2018, the entire subject matter of which is incorporated herein by reference.

TECHNICAL FIELD

This disclosure relates to a printing system.

BACKGROUND ART

A thermal printer that performs printing on a print medium by heating an ink ribbon with a thermal head is known. For example, the thermal printer of background art includes a head reciprocating unit which intermittently reciprocates a thermal printer main body provided with a thermal head along a direction orthogonal to a feeding direction of the print medium. The head reciprocating unit moves the head by one pitch in a width direction of the print medium by controlling movement of the thermal printer main body by one pitch, for example, at a stage when printing on one area in printing areas is ended. At the same time, an ink ribbon feeding unit feeds an ink ribbon only by a used area, which is used by printing for one time, in a length direction thereof, and printing of the next area is completed. At a stage when this printing state is repeated and use of all the areas aligned in the width direction of the ink ribbon is completed, the print medium feeding unit controls the print medium by feeding the print medium one pitch in the feeding direction. By this repetition, the ink ribbon is consumed in a state where unused areas in the width direction are reduced.

According to the printer having the configuration exemplified in JP-A-2009-96001, printing can be executed in such a way that a plurality of images are aligned in the length direction, at positions in the same width direction on the print medium. For example, the printer controls movement of the thermal printer main body by one pitch in the width direction and controls movement of the print medium by one pitch in the length direction, at the stage when printing on one area is ended. The printer then performs printing using an unused area of the ink ribbon at the same position in the width direction as one printed area. Also, in this case, the ink ribbon is used a plurality of times in the width direction, and printing is performed so that use marks of the ink ribbon do not overlap and accordingly, the unused areas of the ink ribbon are consumed in a state of being reduced.

However, in a case where printing control described above is performed in the printer of the related art, when a printing stop instruction is received during printing while using the ink ribbon in the width direction, the printer stops the movement of the thermal printer main body in the width direction so that the ink ribbon is not used further in the width direction. Thereafter, when the printer receives a print resume instruction, the ink ribbon is fed by a predetermined amount and then the next printing is started so that the use marks of the ink ribbon do not overlap in the next printing. In this case, an unused area remains in the width direction of the ink ribbon, which may cause waste of the ink ribbon.

This disclosure is to provide a printing system capable of suppressing waste of an ink ribbon while suppressing use marks of the ink ribbon from overlapping.

SUMMARY

A printing system includes: a movable printing device; a control unit; an interface; and a device moving unit that is configured to move the movable printing device, wherein the movable printing device includes a thermal head and a ribbon transport unit that is configured to transport an ink ribbon in a direction orthogonal to a moving direction of the movable printing device, wherein the control unit is configured to: execute, when a print command is received via the interface, print operation control including: device position control of causing the device moving unit to move the movable printing device and positioning the movable printing device in a width direction of a print medium; ribbon transport control of causing the ribbon transport unit to transport the ink ribbon and transporting the ink ribbon between the print medium and the thermal head in a length direction of the print medium; and head print control of causing the thermal head to heat the ink ribbon being transported and executing printing on the print medium; execute, when a print stop command is received via the interface, print stop control of releasing a standby state where printing is executable after execution of the print operation control is completed; execute, when a print resume command is received via the interface after a start of execution of the print stop control, print resume control of: causing the device moving unit to resume the device position control from a stop position of the movable printing device: causing the ribbon transport unit to resume the ribbon transport control from a stop position of the ink ribbon; and causing the thermal head to resume printing from a print interruption position of the ink ribbon, and execute, when predetermined information is received via the interface after the start of execution of the print stop control, reset control of causing the device moving unit to move the movable printing device to a reference position, causing the ribbon transport unit to transport the ink ribbon by a predetermined amount and then restarting the print operation control.

According to the printing system of this aspect, the printing device can be moved along rails, and the ink ribbon can be transported in the direction orthogonal to the moving direction of the printing device. When the control unit receives the print command via the interface, the control unit executes the print operation control. When the control unit receives the print stop command via the interface, the control unit executes the print stop control. When the control unit receives the print resume command via the interface after the start of execution of the print stop control, the control unit resumes the print operation control from the stop position of the printing device, the stop position of the ink ribbon, and the print interruption position of the ink ribbon. When the control unit receives predetermined information via the interface after the start of execution of the print stop control, and the print operation control, the control unit restarts the print operation control after executing the reset control of moving the printing device to an initial position and transporting the ink ribbon by a predetermined amount.

According to this, when the control unit receives the print resume command via the interface after the start of execution of the print stop control, the print operation control is resumed from the stop position of the printing device in the print stop control, the stop position of the ink ribbon, and the print interruption position of the ink ribbon. In this case, since the print operation control resumes so as to continue from before the execution of the print stop control, it is possible to suppress waste of the ink ribbon while suppressing the use marks of the ink ribbon from overlapping. On the other hand, when the control unit receives the predetermined information via the interface after the start of execution of the print stop control, the print operation control is restarted after the reset control is executed. In this case, since the next printing is started after the ink ribbon is fed by a predetermined amount, the print operation control can be resumed while suppressing the use marks of the ink ribbon from overlapping. Accordingly, the printing system can suppress waste of the ink ribbon while suppressing the use marks of the ink ribbon from overlapping.

BRIEF DESCRIPTION OF THE DRAWINGS

The foregoing and additional features and characteristics of this disclosure will become more apparent from the following detailed descriptions considered with the reference to the accompanying drawings, wherein.

DESCRIPTION OF EMBODIMENTS

Overview of Printing System 1

One embodiment of this disclosure will be described with reference to the drawings. The printing system 1 is a system for performing thermal transfer printing. The printing system 1 performs printing on a print medium P (see FIG. 2) transported by an external apparatus 8 (see FIG. 3). A specific example of the external apparatus 8 includes a packaging machine that transports the packaging material. In this case, for example, the printing system 1 is used by being incorporated into a part of a transport line on which the print medium P is transported by the packaging machine.

Figure 1:
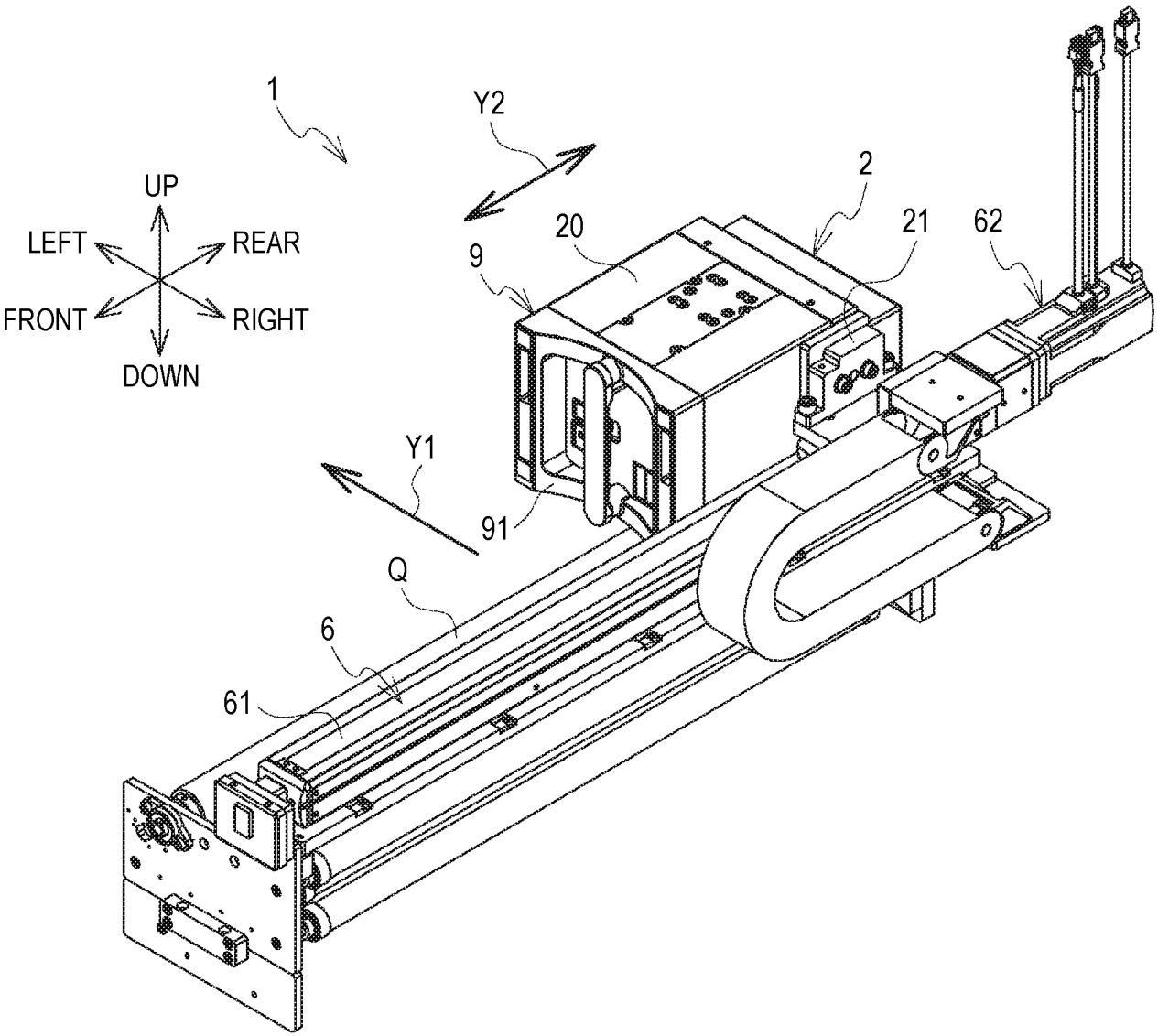
FIG. 1 is a perspective view of a printing system.

As illustrated in FIG. 1, the printing system 1 includes a movable printing device 2, control units 2A and 7A (see FIG. 3), a controller 7, and a bracket motor 62 for moving the printing device 2. The printing system 1 of this embodiment includes the printing device 2, a bracket 6, a controller 7 (see FIG. 3), and a platen roller Q. Hereinafter, in order to help understanding of the description of the drawings, above, below, the left, the right, the front, and the rear of each configuration included in the printing system 1 will be defined. The above, the below, the left, the right, the front, and the rear of the printing device 2 and the bracket 6 correspond to an upper side, a lower side, an obliquely upper left side, an obliquely lower right side, an obliquely lower left side, and an obliquely upper right side in FIG. 1, respectively. In FIG. 1, a transport direction of the print medium P coincides with the horizontal direction. The print medium P is transported in the left direction (in a direction of the arrow Y1) by the external apparatus 8.

Cassette 9

Figure 2:
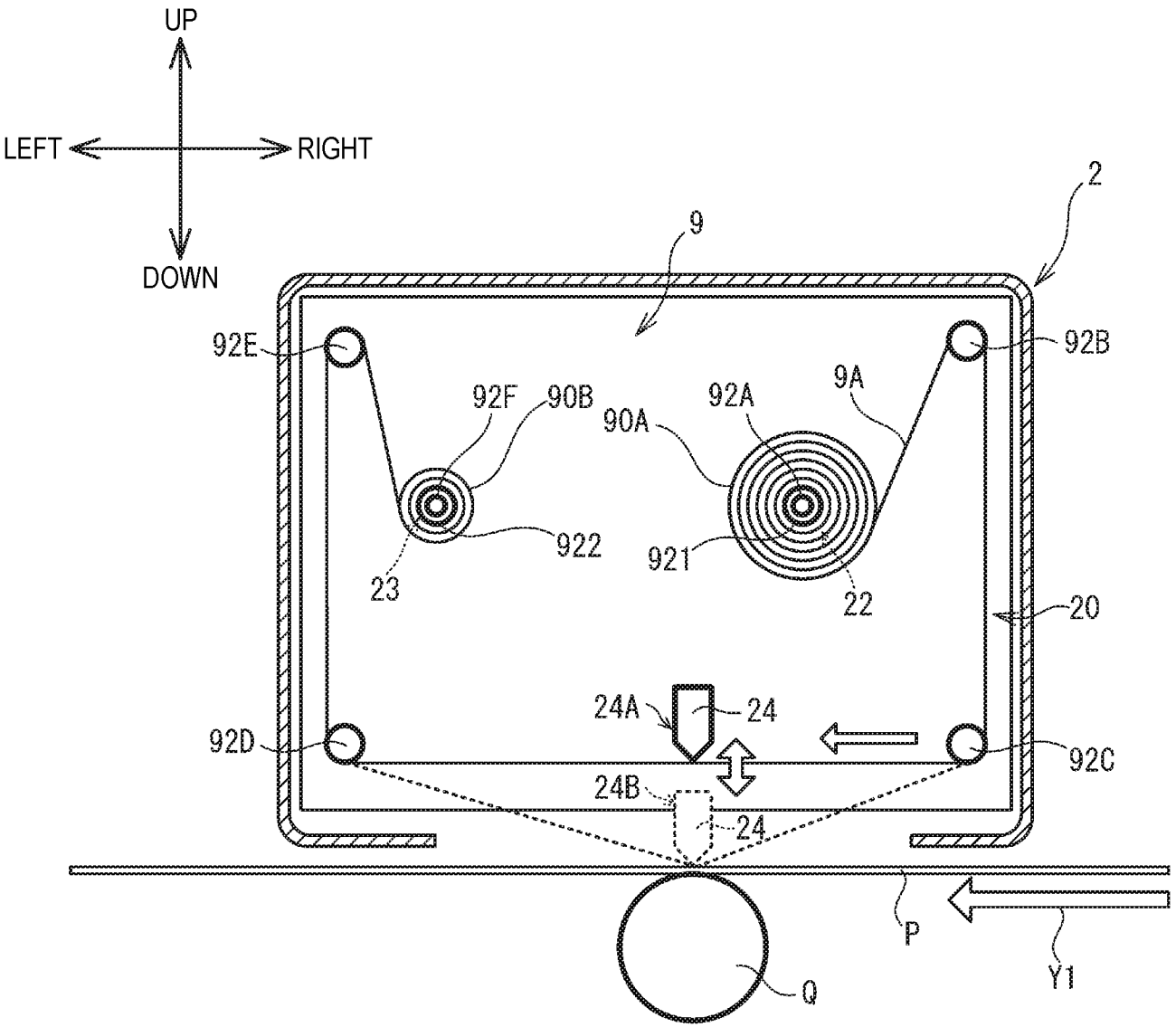
FIG. 2 is a diagram for explaining an overview of a printing device.

In the printing system 1, printing on the print medium P is performed in a state where the cassette 9 is attached to a cassette attachment unit 20 of the printing device 2. The printing device 2 performs printing by heating the ink ribbon 9A (see FIG. 2) of the cassette 9. As illustrated in FIG. 2, the cassette 9 includes a lid 91, shafts 92A to 92F, a supply roll 90A, and a winding roll 90B. The shafts 92A to 92F are spindles that are rotatable around a rotation axis extending in the front-and-rear direction. The shafts 92A to 92F extend rearward from the rear surface of the lid 91.

The shafts 92A and 92F are aligned in the horizontal direction above the center of the lid 91 in the vertical direction. A spool 921 to which one end of the ink ribbon 9A is connected is attached to the shaft 92A. A spool 922 to which the other end of the ink ribbon 9A is connected is attached to the shaft 92F. In each of the spools 921 and 922, the ink ribbon 9A is wound in a roll shape. The supply roll 90A is configured by winding the ink ribbon 9A around the spool 921. The winding roll 90B is configured by winding the ink ribbon 9A around the spool 922.

The ink ribbon 9A is fed from the supply roll 90A by the printing device 2 and wound around the winding roll 90B. The shaft 92B is provided at the upper right corner of the lid 91. The shaft 92C is provided at the lower right corner of the lid 91. The shaft 92D is provided at the lower left corner of the lid 91. The shaft 92E is provided at the upper left corner of the lid 91. The ink ribbon 9A stretched between the supply roll 90A and the winding roll 90B is in contact with a part of a circumferential surface of each of the shafts 92B to 92E.

Platen Roller Q

As illustrated in FIGS. 1 and 2, the platen roller Q has a cylindrical shape. The platen roller Q is rotatable around a rotation axis extending in the front-and-rear direction. The printing device 2 is disposed above the platen roller Q. The print medium P and the ink ribbon 9A are sandwiched between the platen roller Q and a thermal head 24 of the printing device 2. The platen roller Q contacts the print medium P transported by the external apparatus 8 from below and presses the print medium P against the ink ribbon 9A.

Printing Device 2

Figure 3:
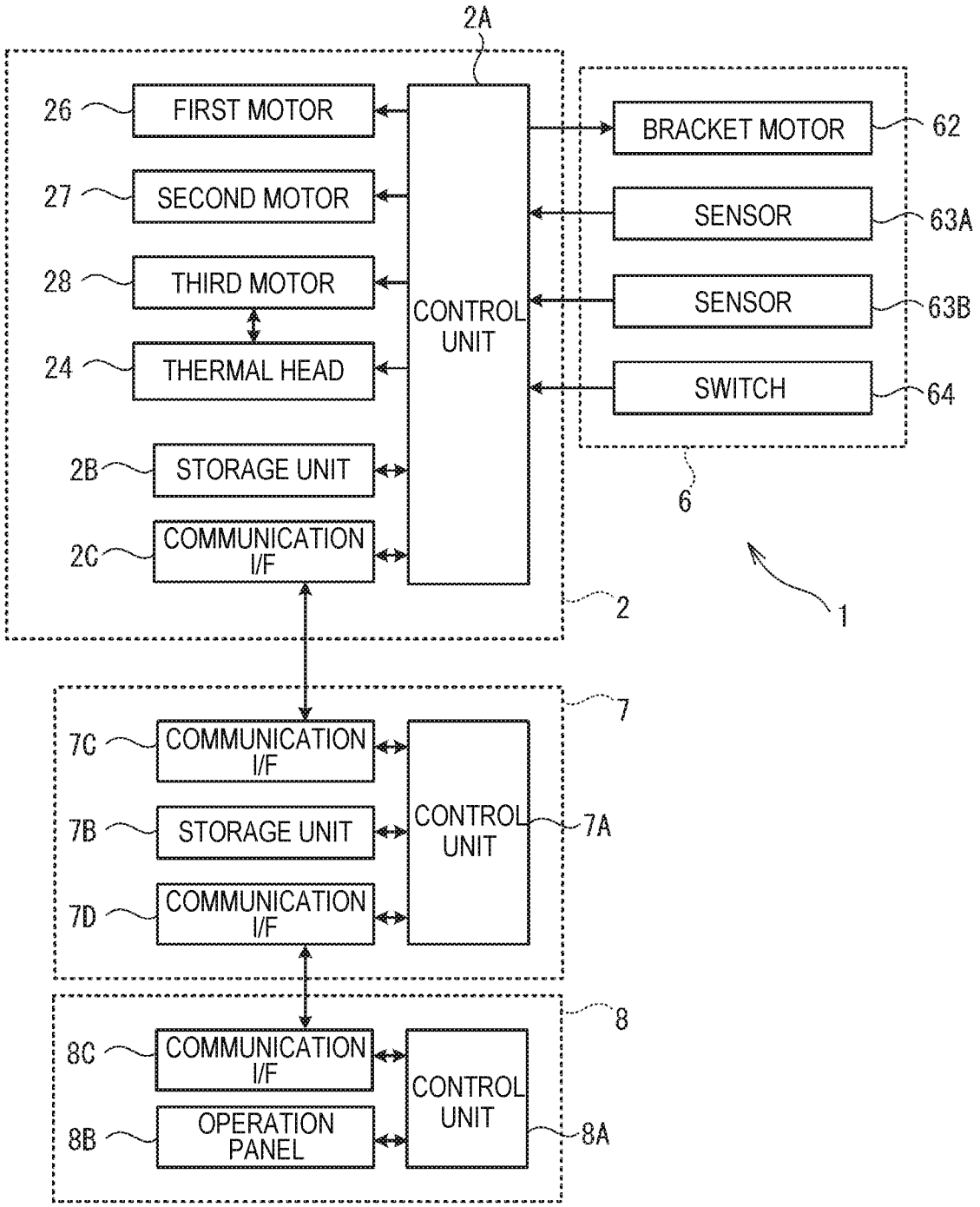
FIG. 3 is a block diagram illustrating an electrical configuration of the printing system 1.

The printing device 2 is a thermal transfer thermal printer. The printing device 2 includes the thermal head 24 and a first motor 26 and a second motor 27 that transport the ink ribbon 9A in a direction orthogonal to a moving direction of the printing device 2. As illustrated in FIGS. 2 and 3, the printing device 2 of this embodiment includes a supply unit 22, a winding unit 23, the thermal head 24, a control board (not illustrated), the first motor 26, the second motor 27, a third motor 28, and the like. When the cassette 9 illustrated in FIG. 2 is attached to the cassette attachment unit 20 of the printing device 2, the shaft 92A is connected to the supply unit 22 and the shaft 92F is connected to the winding unit 23. The supply roll 90A wound around the spool 921 of the shaft 92A is attached to the supply unit 22. The winding roll 90B wound around the spool 922 of the shaft 92F is attached to the winding unit 23.

The first motor 26 and the second motor 27 are stepping motors. The first motor 26 can rotate the supply roll 90A attached to the supply unit 22 by rotationally driving the supply unit 22. The second motor 27 can rotate the winding roll 90B attached to the winding unit 23 by rotationally driving the winding unit 23. When the first motor 26 and the second motor 27 rotate in a state where the cassette 9 is attached to the printing device 2, the ink ribbon 9A is transported between the supply roll 90A and the winding roll 90B in the printing devices 2 while being guided in contact with the shafts 92B to 92E.

In detail, when the supply roll 90A and the winding roll 90B rotate in a forward rotation direction which is a counterclockwise direction in a state where the printing device 2 in FIG. 2 is viewed from the front, the ink ribbon 9A is fed from the supply roll 90A and wound around the winding roll 90B. When the supply roll 90A and the winding roll 90B rotate in a reverse rotation direction which is the clockwise direction in a state where the printing device 2 in FIG. 2 is viewed from the front, the ink ribbon 9A is fed from the winding roll 90B and wound around the supply roll 90A.

The thermal head 24 is a line thermal head having a plurality of heating elements linearly aligned in the front-and-rear direction. The thermal head 24 contacts a portion stretched between the shafts 92C and 92D of the ink ribbon 9A transported from the supply roll 90A of the cassette 9 toward the winding roll 90B from above. The thermal head 24 sandwiches the print medium P and the ink ribbon 9A with the platen roller Q disposed below the printing device 2. The thermal head 24 performs printing on the print medium P by heating the ink ribbon 9A while pressing the ink ribbon 9A against the print medium P.

The third motor 28 is a stepping motor. The third motor 28 moves the thermal head 24 between head positions 24A and 24B via a gear in the vertical direction. The thermal head 24 approaches the platen roller Q by moving downward, and is separated from the platen roller Q by moving upward. The moving direction (vertical direction) of the thermal head 24 is orthogonal to the transport direction (horizontal direction) of the ink ribbon 9A transported between the shafts 92C and 92D. The head position 24B is a position where the thermal head 24 contacts the ink ribbon 9A and urges the ink ribbon 9A toward the platen roller Q. The head position 24A is a position where the thermal head 24 is disposed above the head position 24B and urging of the ink ribbon 9A to the platen roller Q is released.

Bracket 6

As illustrated in FIG. 1, the bracket 6 moves the printing device 2 in the front-and-rear direction (in a direction of the arrow Y2) orthogonal to the horizontal direction which is the transport direction of the print medium P (see FIG. 2). The bracket 6 includes a support portion 61, the bracket motor 62, a lead screw (not illustrated), and a ball screw (not illustrated). The support portion 61 has a substantially box shape that is long in the front-and-rear direction. The bracket motor 62 is a stepping motor that moves the printing device 2. The lead screw is disposed inside the support portion 61 and extends in the front-and-rear direction. The rear end portion of the lead screw is coupled to a rotation shaft of the bracket motor 62. The ball screw is screwed into the lead screw, and moves in the front-and-rear direction according to rotation of the lead screw. The ball screw is connected to a coupling portion 21 provided at the right end of the printing device 2.

The printing device 2 rotates the lead screw by rotationally driving the bracket motor 62. According to the movement of the ball screw in the front-and-rear direction by the rotation of the lead screw, the printing device 2 moves in the front-and-rear direction in the movable range. The bracket motor 62 outputs a signal indicating the number of steps of the bracket motor 62 to the control unit 2A while the bracket motor 62 is rotationally driven. The control unit 2A acquires current position information indicating the current position of the printing device 2 based on the number of steps of the bracket motor 62.

Controller 7

As illustrated in FIG. 3, the controller 7 is interposed between the printing device 2 and the external apparatus 8. The controller 7 outputs data required for the printing device 2 to perform printing to the printing device 2. A specific example of data output from the controller 7 to the printing device 2 includes print data of a print image and setting information on printing. The controller 7 also transmits a signal output from the external apparatus 8 to the printing device 2. Examples of the signals output from the external apparatus 8 include a transport start signal and a transport stop signal of the print medium P, a speed signal indicating the transport speed of the print medium P, and a print signal for notifying the printing time for the print medium P.

The control unit 2A of the printing device 2 stores reference position information indicating a reference position of the printing device 2 in a storage unit 2B based on the print data and setting information output from the controller 7. The reference position is a position of the printing device 2 in the front-back direction that becomes the reference when printing a print image to be printed, and differs according to the print image to be printed. As an example, the print image to be printed is an image of a label to be printed on the print medium P. The control unit 2A stores the reference position information in the storage unit 2B based on the reference position corresponding to the image of the label to be printed.

Electrical Configuration

An electrical configuration of the printing system 1 will be described with reference to FIG. 3. The printing device 2 includes a control unit 2A, a storage unit 2B, a communication interface 2C, the thermal head 24, the first motor 26, the second motor 27, and the third motor 28. The control unit 2A, the storage unit 2B, and the communication interface 2C are equipped in a control board (not illustrated). The control unit 2A is electrically connected to the storage unit 2B, the communication interface 2C, the thermal head 24, the first motor 26, the second motor 27, and the third motor 28.

The control unit 2A executes a main process (see FIG. 6) by reading and executing a program stored in the storage unit 2B. The storage unit 2B stores a program for the control unit 2A to execute the main process. The communication interface 2C is an in printing time interface element for communicating between the printing apparatus 2 and the controller 7. The communication interface 2C is connected to the controller 7 via a communication cable.

The storage unit 2B stores data, that is, print data and setting information, output from the controller 7. The setting information in this embodiment includes parameters of print density, print image length, print resolution, head temperature, ribbon width, and RRS (radial ribbon save) maximum number of rows, and the like. The print density is print density of an image to be printed by the thermal head 24. The print image length is a length of the ink ribbon 9A in the transport direction in the image to be printed by the thermal head 24. The print resolution is resolution of an image to be printed by the thermal head 24. The head temperature is heating temperature of the thermal head 24 at the time of printing. The ribbon width is a length of the ink ribbon 9A in a width direction. The RRS maximum number of rows is the maximum number of a plurality of images to be printed aligned in the width direction of the ink ribbon 9A by the thermal head 24.

The program to be executed by the control unit 2A may be downloaded from an external terminal such as the controller 7, the external apparatus 8, or a PC, and stored in the storage unit 2B. The print data and the setting information may be input from, for example, the external apparatus 8, the external terminal such as a PC, or the operation unit of the printing device 2 and may be set in the storage unit 2B.

The thermal head 24 generates heat by energizing heating elements in accordance with a control signal from the control unit 2A. The first motor 26 rotates the supply unit 22 by rotating according to a pulse signal output from the control unit 2A. The second motor 27 rotates the winding unit 23 by rotating according to the pulse signal output from the control unit 2A. The third motor 28 moves the thermal head 24 in the vertical direction by rotating according to the pulse signal output from the control unit 2A.

The bracket 6 includes the bracket motor 62, sensors 63A and 63B, and a switch 64. The bracket motor 62 moves the printing device 2 in the front-and-rear direction by rotating according to the pulse signal output from the control unit 2A. The sensors 63A and 63B are contact type sensors capable of detecting a position of the printing device 2 in the front-and-rear direction. The switch 64 is a push button switch to which an instruction for the bracket 6 is input.

When the printing device 2 moves to the origin position, which is the front end within the movable range, the sensor 63A detects the printing device 2 and outputs an origin detection signal to the control unit 2A. The control unit 2A stores, in the storage unit 2B, origin position information indicating the origin position of the printing device 2, based on the origin detection signal output from the sensor 63A. When the printing device 2 moves to a movable limit position at the rear end within the movable range, the sensor 63B detects the printing device 2 and outputs a range detection signal to the control unit 2A. The control unit 2A stores movable range information indicating the movable range of the printing device 2 in the storage unit 2B based on the range detection signal output from the sensor 63B.

The controller 7 includes a control unit 7A, a storage unit 7B, and communication interfaces 7C and 7D. The communication interface 7C is an interface element for communicating between the printing device 2 and the controller 7. The communication interface 7C is connected to the printing device 2 via a communication cable. The communication interface 7D is an interface element for communicating between the external apparatus 8 and the controller 7. The communication interface 7D is connected to the external apparatus 8 via a communication cable. Data required for the printing device 2 to execute printing is stored in the storage unit 7B.

The control unit 7A is electrically connected to the storage unit 7B and the communication interfaces 7C and 7D. The control unit 7A reads data required for the printing device 2 to execute printing from the storage unit 7B, and outputs the data to the printing device 2 via the communication interface 7C. The control unit 7A detects a signal received from the external apparatus 8 via the communication interface 7D, and outputs the signal to the printing device 2 via the communication interface 7C.

The external apparatus 8 includes a control unit 8A, an operation panel 8B, and a communication interface 8C. An instruction to the external apparatus 8 is input to the operation panel 8B. The communication interface 8C is an interface element for communicating between the external apparatus 8 and the controller 7. The communication interface 8C is connected to the controller 7 via a communication cable. The control unit 8A is electrically connected to the operation panel 8B and the communication interface 8C. The control unit 8A receives an instruction input to the operation panel 8B. The control unit 8A outputs various signals to the controller 7 via the communication interface 8C.

Overview of Print Operation

An overview of a print operation in the printing system 1 will be described with reference to FIG. 2. When the print operation is started in the printing system 1, the controller 7 outputs data required for printing to the printing device 2. The printing device 2 receives the data and stores it in the storage unit 2B. According to the start of transport of the print medium P by the external apparatus 8, a transport start signal for starting the transport of the print medium P and a speed signal indicating the transport speed of the print medium P are output from the external apparatus 8. The printing device 2 receives the transport start signal and the speed signal via the controller 7.

The print signal notifying the printing time for the print medium P is repeatedly output from the external apparatus 8. The printing device 2 repeatedly receives the print signal via the controller 7. The printing device 2 executes the following print operation according to reception of the print signal. That is, the printing device 2 rotationally drives the first motor 26 and the second motor 27 to rotate the supply roll 90A and the winding roll 90B in the forward rotation direction so that the ink ribbon 9A is transported at a speed synchronized with the transport speed indicated by the speed signal. The ink ribbon 9A moves to the left at a speed synchronized with the print medium P in a transport path between the shafts 92C and 92D. The ink ribbon 9A and the print medium P run in parallel to each other to the left. The printing device 2 rotationally drives the third motor 28 to move the thermal head 24 downward from the head position 24A to the head position 24B. The thermal head 24 sandwiches the ink ribbon 9A and the print medium P with the platen roller Q, and presses the ink ribbon 9A against the print medium P. The heating elements of the thermal head 24 generate heat based on data stored in the storage unit 2B. Ink of the ink ribbon 9A is transferred to the print medium P, and the print image is printed. After printing the print image, the third motor 28 is rotationally driven and the thermal head 24 moves upward from the head position 24B to the head position 24A. The printing device 2 stops rotation of the first motor 26 and the second motor 27. With this configuration, rotation of the supply roll 90A and the winding roll 90B is also stopped, and transport of the ink ribbon 9A is stopped. Printing of the print image is repeatedly performed each time the print signal is received in the printing device 2.

The printing system 1 of this embodiment has a radial ribbon save (RRS) function capable of printing by reducing an unused area in the width direction of the ink ribbon 9A. Specifically, in the printing system 1, the printing device 2 is moved in the width direction (front-and-rear direction) of the ink ribbon 9A before printing for the next one block is started after printing for one block so as to perform printing for the next one block using the unused area in the width direction of the ink ribbon 9A.

Figure 4:
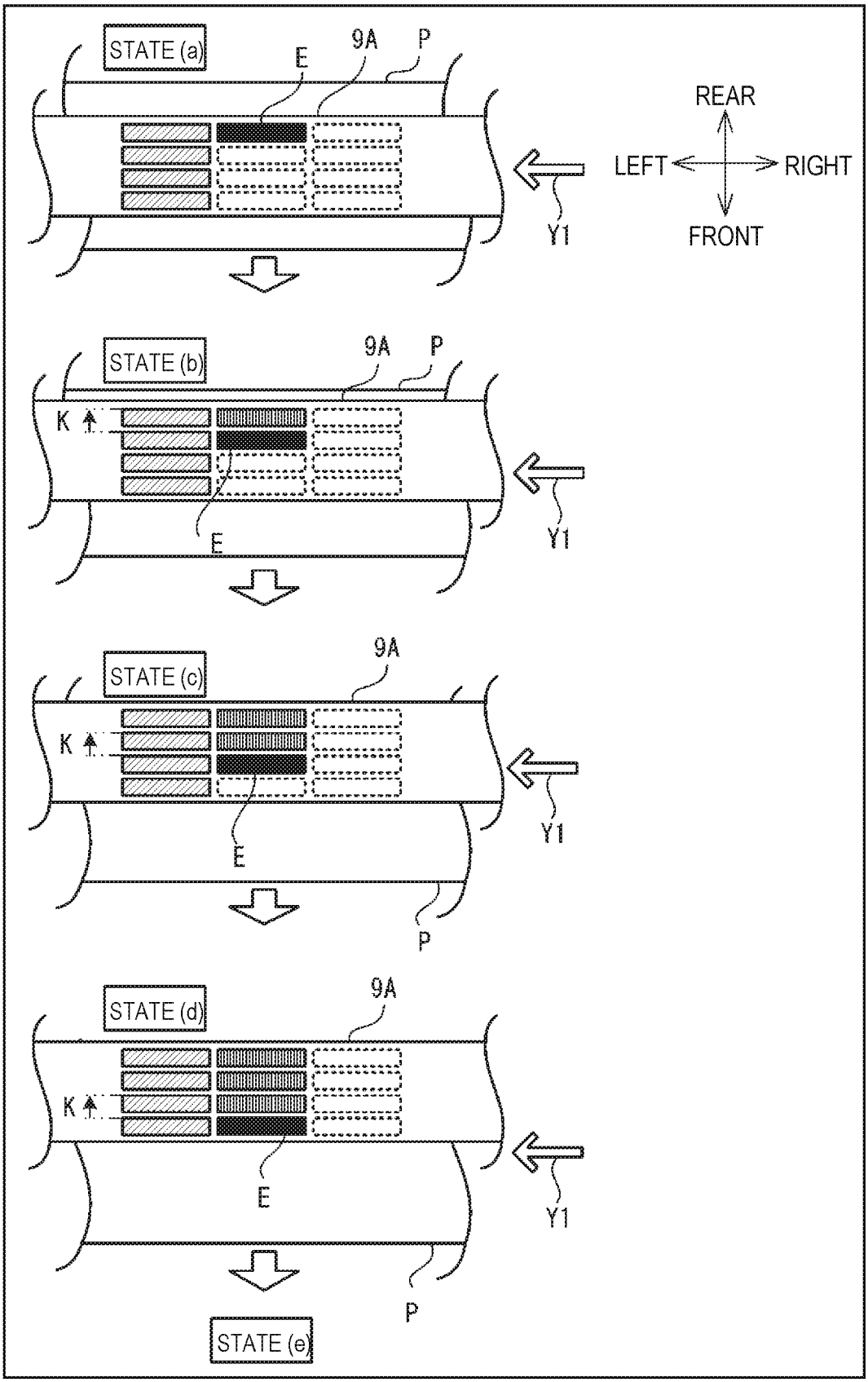
FIG. 4 is a diagram for explaining a flow of a print operation.
Figure 5:
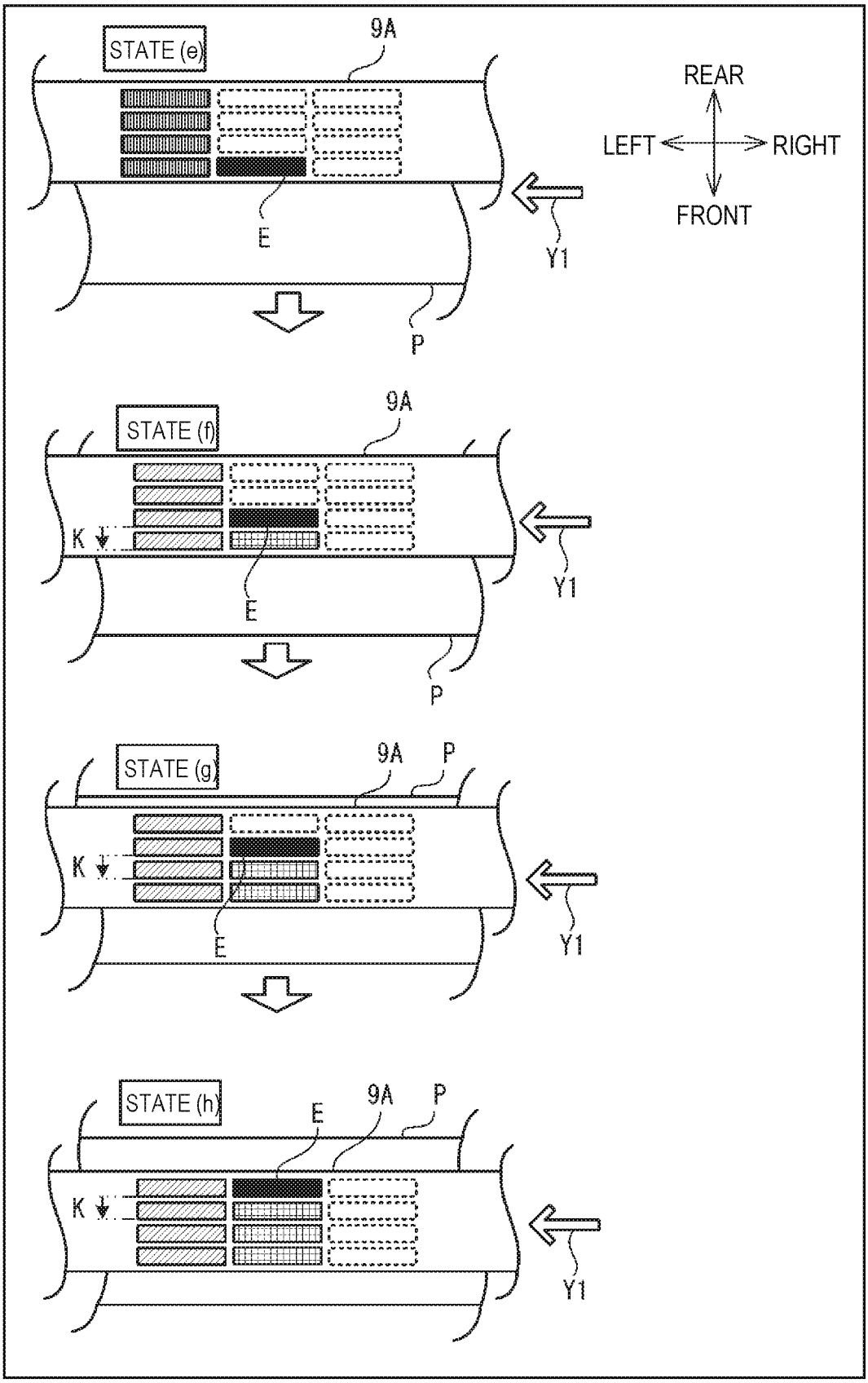
FIG. 5 is another diagram for explaining the flow of the print operation.

Description will be made in detail using a specific example illustrated in FIGS. 4 and 5. In FIG. 4 and FIG. 5, a used area E of this time in the ink ribbon 9A is shown in black, and used areas are shown by areas which are surrounded by solid lines and rendered with half-tone oblique lines, half-tone vertical lines, and half-tone meshing, and unused areas are shown by white areas surrounded by dotted lines. In the specific example illustrated in FIGS. 4 and 5, a length in the width direction of the used area (image range) E of the ink ribbon 9A used by being heated in printing for one block is smaller than one-fourth of a length in the width direction of the ink ribbon 9A.

In a state (a), the printing device 2 prints one block using a rear-most unused area of the ink ribbon 9A. In this case, in the printing system 1, the following forward preparation control is executed before printing for the next one block is started. That is, the printing device 2 rotationally drives the third motor 28 to move the thermal head 24 upward from the head position 24B to the head position 24A. The printing device 2 rotationally drives the first motor 26 and the second motor 27 to rotate the supply roll 90A and the winding roll 90B in the reverse rotation direction so as to rewind the ink ribbon 9A to the supply roll 90A side by the length in the transport direction of the used area E. The bracket 6 moves the printing device 2 rearward by a distance K by rotational driving of the bracket motor 62. The distance K is a distance obtained by adding the length of the use area E in the front-and-rear direction and the length of a predetermined margin in the front-and-rear direction. With this configuration, the position of the ink ribbon 9A with respect to the print medium P is relatively moved rearward by the distance K.

Next, as illustrated in a state (b), when the print signal is received, the printing device 2 executes printing for one block at the same position in the front-and-read direction as one block printed on the print medium P in the state (a). The printing device 2 executes printing for one block using an unused area in front of the used area E in the state (a). Thereafter, in the printing system 1, the forward preparation control is executed, and the position of the ink ribbon 9A with respect to the print medium P is relatively moved rearward by the distance K. Similarly, as illustrated in a state (c), the printing device 2 executes printing for one block using an unused area in front of the used area E in the state (b). As illustrated in a state (d), the printing device 2 executes printing for one block using an unused area in front of the used area E in the state (c). With this configuration, the printing device 2 executes printing for one column consisting of four blocks aligned in the width direction on the print medium P, using four unused areas aligned in the width direction of the ink ribbon 9A in order from the rear side.

In the printing system 1, when printing for four blocks is completed as illustrated in the state (d), an unused area in which one block can be printed does not exist in front of the used area E in the ink ribbon 9A. In this case, in the printing system 1, the following normal preparation control is executed before printing for the next one block is started. That is, the printing device 2 rotationally drives the third motor 28 to move the thermal head 24 upward from the head position 24B to the head position 24A. The printing device 2 rotationally drives the first motor 26 and the second motor 27 to rotate the supply roll 90A and the winding roll 90B in the forward rotation direction, thereby causing the ink ribbon 9A to run parallel to the print medium P. The bracket 6 maintains the position of the printing device 2 in the front-and-rear direction without rotationally driving the bracket motor 62.

Next, as illustrated in a state (e), when the print signal is received, the printing device 2 executes printing for one block at the same position in the front-and-rear direction as the one block printed on the print medium P in the state (a). The printing device 2 executes printing for one block using an unused area located upstream (rightward) of the ink ribbon 9A in the transport direction with respect to the used area E of the state (d). In the state (e), the printing device 2 prints one block using the front-most unused area of the ink ribbon 9A. In this case, in the printing system 1, rearward preparation control is executed before printing for the next one block is started. The rearward preparation control is basically the same as the frontward preparation control, but is different from the frontward preparation control in that the bracket 6 moves the printing device 2 forward by the distance K by rotational driving of the bracket motor 62. With this configuration, the position of the ink ribbon 9A with respect to the print medium P is relatively moved forward by the distance K.

Next, as illustrated in a state (f), when the print signal is received, the printing device 2 executes printing for one block at the same position in the front-and-rear direction as the one block printed on the print medium P in the state (a). The printing device 2 executes printing for one block using an unused area in rear of the used area E in the state (e). Thereafter, in the printing system 1, the rearward preparation control is executed to relatively move the position of the ink ribbon 9A with respect to the print medium P forward by the distance K. Similarly, as illustrated in a state (g), the printing device 2 executes printing for one block using an unused area in the rear of the used area E in the state (f). As illustrated in a state (h), the printing device 2 executes printing for one block using an unused area in the rear of the used area E in the state (g). With this configuration, the printing device 2 executes printing for one column consisting of four blocks aligned in the width direction on the print medium P, using the four unused areas aligned in the width direction of the ink ribbon 9A in order from the front side.

As illustrated in the state (h), when printing for four blocks is completed, an unused area in which one block can be printed does not exist in rear of the used area E in the ink ribbon 9A. In this case, in the printing system 1, the following normal preparation control is executed before printing for the next one block is started. When the print signal is received, the printing device 2 uses an unused area located upstream (rightward) of the ink ribbon 9A in the transport direction with respect to the used area E of the state (h) to execute printing for one block, similarly to the state (a). In the printing system 1, by repeatedly executing the states (a) to (h), the unused areas in the ink ribbon 9A can be used so as to meander and printing of a plurality of blocks aligned in the transport direction can be performed on the print medium P.

A transport stop signal for stopping the transport of the print medium P is output from the external apparatus 8 according to the stop of the transport of the print medium P by the external apparatus 8. The printing device 2 receives the transport stop signal via the controller 7. The print operation in the printing system 1 is stopped.

Main Process

Figure 6:
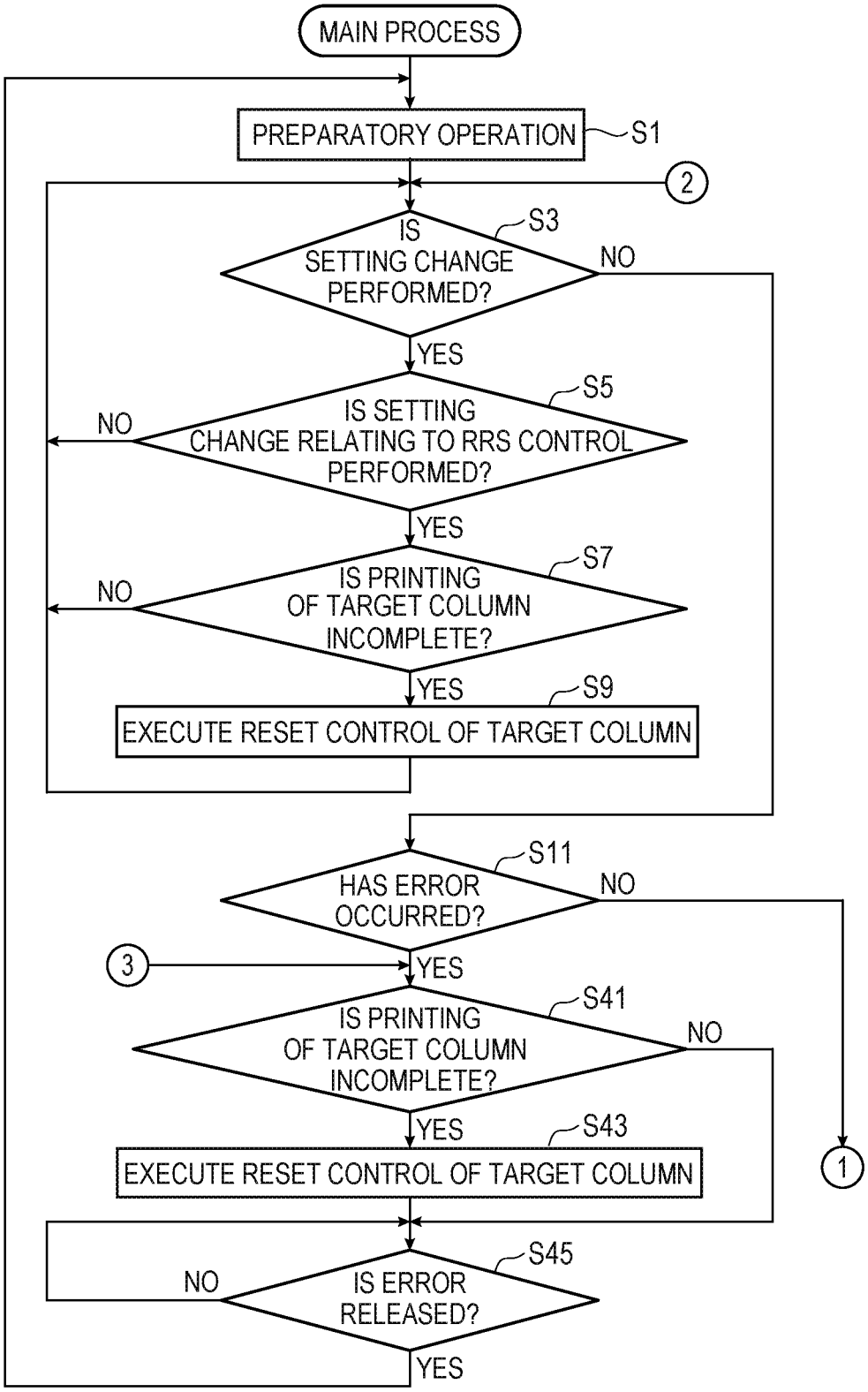
FIG. 6 is a flowchart of a main process.

A main process of the printing device 2 will be described with reference to FIGS. 6 and 7. The control unit 2A of the printing device 2 starts the main process by reading and executing a program stored in the storage unit 2B when the power of the printing device 2 is turned ON. As illustrated in FIG. 6, first, the control unit 2A executes the following preparation operation (S1). First, the control unit 2A moves the printing device 2 forward until the sensor 63A detects the printing device 2. When the sensor 63A detects the printing device 2, the control unit 2A acquires origin position information and stores it in the storage unit 2B. Next, the control unit 2A moves the printing device 2 rearward from the origin position until the sensor 63B detects the printing device 2. When the sensor 63B detects the printing device 2, the control unit 2A acquires movable range information and stores it in the storage unit 2B. Next, the control unit 2A moves the printing device 2 in the front-and-rear direction so that the current position of the printing device 2 coincides with the reference position indicated by the reference position information stored in the storage unit 2B.

Next, the control unit 2A determines whether setting change is performed (S3). As an example, when a user inputs a setting information change instruction from the external apparatus 8, the controller 7 outputs the setting information change instruction to the printing device 2. When the setting information change instruction is received via the controller 7, the control unit 2A determines that setting change is performed (YES in S3). In this case, the control unit 2A changes a parameter included in the setting information stored in the storage unit 2B according to contents of a setting change instruction.

The control unit 2A determines whether the setting change relating to RRS control is performed (S5). The RRS control is control of moving the printing device 2 in the front-and-rear direction by a RRS function. The setting change relating to the RRS control is a setting change of parameters that affect the RRS control. In the present embodiment, when at least one parameter of ribbon width and RRS maximum number of rows is changed among parameters included in the setting information stored in the storage unit 2B, the number of times that the printing device 2 is moved in the width direction of the ink ribbon 9A by RRS control may be changed. Accordingly, when at least one parameter of the ribbon width and the RRS maximum number of rows is changed, the control unit 2A determines that the setting change relating to the RRS control is performed (YES in S5).

In this case, the control unit 2A determines whether printing of a target column of the ink ribbon 9A is incomplete (S7). In detail, at the time of execution of S7, the printing device 2 is in a state of stopping the print operation. When the printing device 2 is in a standby state for print operation accompanying the RRS control in S7 and printing using the target column of the ink ribbon 9A is incomplete in S7, the control unit 2A determines that printing of the target column is incomplete (YES in S7). The target column of the ink ribbon 9A is one column, which is in use by the thermal head 24, of the ink ribbon 9A, and is configured by a plurality of areas aligned in the width direction of the ink ribbon 9A. "The printing using the target column of the ink ribbon 9A is incomplete" means that an area whose printing is incomplete is included in a plurality of areas constituting the target column of the ink ribbon 9A.

In this case, the control unit 2A executes reset control of the target column (S9). The reset control of the target column includes ribbon delivery control and reference position return control. The ribbon delivery control is control of transporting the ink ribbon 9A until the thermal head 24 faces a new column adjacent to the column currently being printed by rotationally driving the first motor 26 and the second motor 27 to rotate the supply roll 90A and the winding roll 90B in the forward rotation direction by a predetermined amount. That is, the ribbon delivery control switches the target column of the ink ribbon 9A to the next column upstream in the transport direction with respect to the column currently being printed. The reference position return control is control of moving the printing device 2 to the reference position in the front-and-rear direction by rotationally driving the bracket motor 62 based on the reference position information stored in the storage unit 2B. By the reset control described above, the printing device 2 is controlled to go into a state capable of restarting printing using a new column of the ink ribbon 9A.

When it is determined that the setting change for RRS control is not performed (NO in S5), when it is determined that printing of the target column is not incomplete (NO in S7), or after execution of S9, the control unit 2A returns the process to S3. In this embodiment, when at least one parameter of print density, print image length, the print resolution, and the head temperature among the parameters included in the setting information stored in the storage unit 2B is changed, the control unit 2A determines that the setting change relating to the RRS control is not performed (NO in S5). When it is determined that the setting change is not performed (NO in S3), the control unit 2A determines whether an error has occurred (S11). For example, when the ink ribbon 9A is not attached to the printing device 2 or when an operation failure occurs in the printing device 2, the control unit 2A determines that an error has occurred (YES in S11). In this case, the control unit 2A causes the process to proceed to S41.

Figure 7:
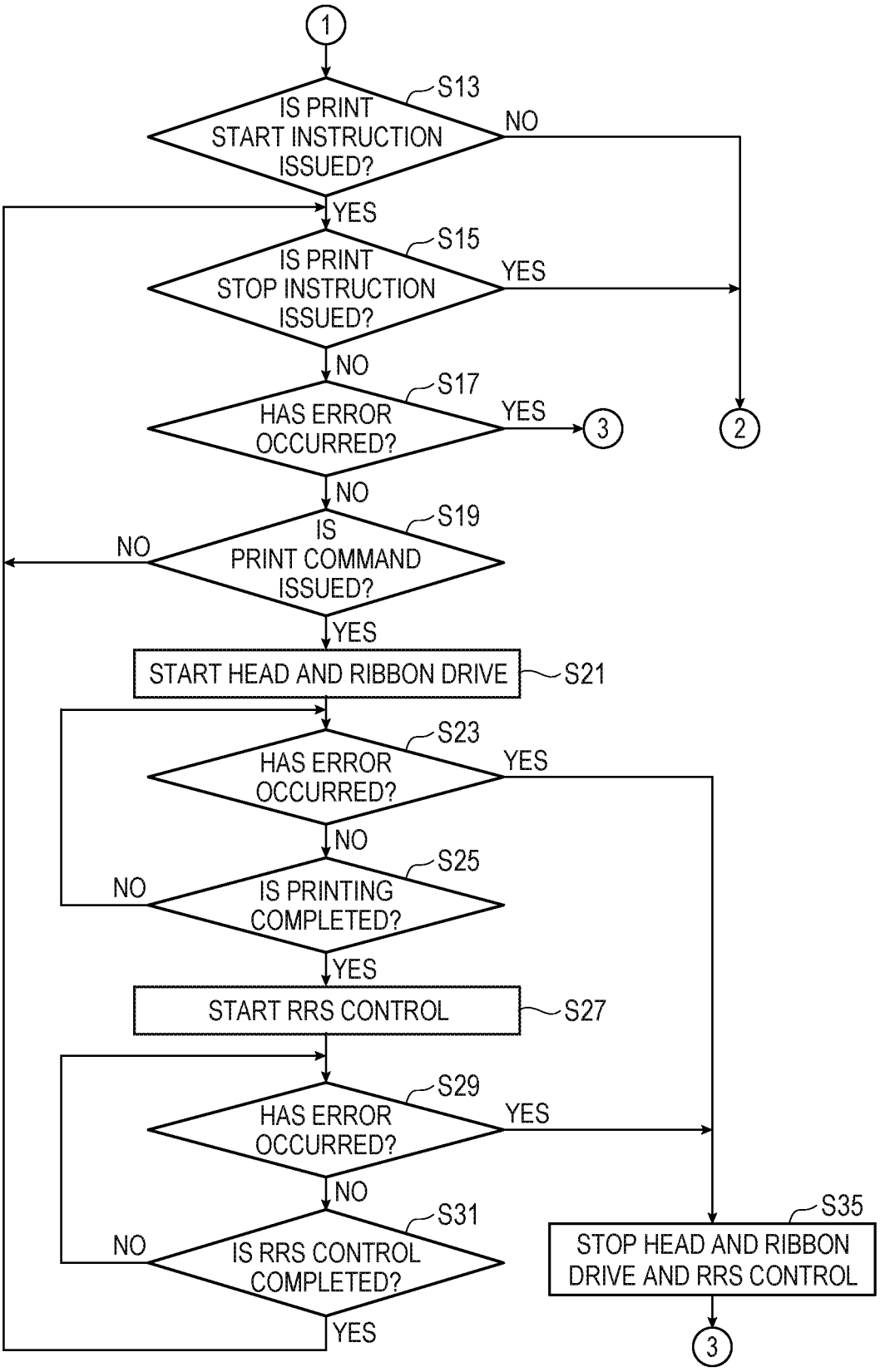
FIG. 7 is another flowchart of the main process.

When it is determined that an error has not occurred (NO in S11), as illustrated in FIG. 7, the control unit 2A determines whether a print start instruction is issued (S13). As an example, when the user inputs the print start instruction from the external apparatus 8, the controller 7 outputs the input print start instruction to the printing device 2. When the print start instruction is received via the controller 7, the control unit 2A determines that the print start instruction is issued (YES in S13). In this case, the control unit 2A controls the printing device 2 to go into a standby state where printing is executable. When it is determined that the print start instruction is not issued (NO in S13), the control unit 2A returns the process to S3.

When it is determined that the print start instruction is issued (YES in S13), the control unit 2A determines whether a print stop instruction is issued (S15). As an example, when the user inputs the print stop instruction from the external apparatus 8, the controller 7 outputs the input print stop instruction to the printing device 2. When the print stop instruction is received via the controller 7, the control unit 2A determines that the print stop instruction is issued (YES in S15). When it is determined that the print stop instruction is not issued (NO in S15), the control unit 2A determines whether an error has occurred, similarly to S11 (S17). When it is determined that the error has occurred (YES in S17), the control unit 2A causes the process to proceed to S41. When it is determined that the error has not occurred (NO in S17), the control unit 2A determines whether the print command is issued (S19). When the print signal is received from the controller 7, the control unit 2A determines that the print command is issued (YES in S19). When it is determined that the print command is not issued (NO in S19), the control unit 2A returns the process to S15.

When it is determined that the print command is issued (YES in S19), the control unit 2A executes the print operation control of S21 to S31. First, the control unit 2A starts head and ribbon drive (S21). That is, the control unit 2A rotationally drives the third motor 28 to move the thermal head 24 from the head position 24A to the head position 24B, and starts energization of the thermal head 24. The control unit 2A rotationally drives the first motor 26 and the second motor 27 to cause the ink ribbon 9A to run parallel to the print medium P. With this configuration, the thermal head 24 starts printing for one block on the print medium P using the ink ribbon 9A.

The control unit 2A determines whether an error has occurred similarly to S11 while head and ribbon drive is being executed (S23). When it is determined that the error has not occurred (NO in S23), the control unit 2A determines whether printing for one block based on the print command is completed (S25). When printing for one block is not completed (NO in S25), the control unit 2A returns the process to S23.

When printing for one block based on the print command is completed (YES in S25), the head and ribbon drive is stopped. The controller 2A starts the RRS control (S27). That is, the control unit 2A rotationally drives the bracket motor 62, and executes any one of the rearward preparation control, the frontward preparation control, or the normal preparation control on the used area E (see FIGS. 4 and 5) of the ink ribbon 9A used in S21 according to an unused area to be used next. With this configuration, the thermal head 24 is moved from the head position 24B to the head position 24A. In order to perform printing using the next unused area in the ink ribbon 9A, the position of the printing device 2 in the front-and-rear direction is controlled.

The control unit 2A determines whether an error has occurred similarly to S11 while the RRS control is being executed (S29). When it is determined that the error has not occurred (NO in S29), the controller 2A determines whether the RRS control is completed (S31). When it is determined that the RRS control is not completed (NO in S31), the control unit 2A returns the process to S29. When it is determined that the RRS control is completed (YES in S31), the RRS control is stopped. The control unit 2A returns the process to S15.

In the print operation control of S21 to S31, the control unit 2A prints the print image on the print medium P using the ink ribbon 9A based on the print data stored in the storage unit 2B and the plurality of parameters included in the setting information. The setting information includes a first parameter for which the reset control (S9) is not needed and a second parameter for which the reset control (S9) is needed. The first parameters in this embodiment are parameters such as the print density, the print image length, the print resolution, and the head temperature. When the first parameter is changed, it is determined that the setting change relating to the RRS control is not performed (NO in S5). The second parameters in this embodiment are parameters such as the ribbon width and the RRS maximum number of rows. When the second parameter is changed, it is determined that the setting change relating to the RRS control is performed (YES in S5).

Accordingly, the control unit 2A executes the print operation control based on a plurality of parameters including at least one first parameter for which the reset control is needed (S21 to S31). The at least one first parameter includes a parameter of print density of an image to be printed by the thermal head 24 using the ink ribbon 9A. The control unit 2A executes the print operation control based on a plurality of parameters including at least one second parameter requiring the reset control (S21 to S31). The at least one second parameter includes the parameter of the maximum number of columns, which is the maximum number of the plurality of images to be printed by the thermal head 24 aligned in the width direction of the ink ribbon 9A.

As described above, when the print command is received via the controller 7, the control unit 2A executes the print operation control including device position control, ribbon transport control, and head print control (S21 to S31). In the device position control, the printing device 2 is positioned in the width direction of the printing medium P by causing the bracket motor 62 to move the printing device 2. In the ribbon transport control, the ink ribbon 9A is transported between the print medium P and the thermal head 24 in the length direction of the print medium P by causing the first motor 26 and the second motor 27 to transport the ink ribbon 9A. In the head print control, printing of the print medium P is performed by causing the thermal head 24 to heat the ink ribbon 9A being transported.

When it is determined that the print stop instruction is issued after the completion of printing and RRS control (YES in S25, YES in S31, and YES in S15), the control unit 2A releases the standby state where printing is executable, and returns the process to S3. As described above, when the print stop command is received via the controller 7, the control unit 2A executes the print stop control of releasing the standby state where printing is executable after execution of the print operation control is completed (YES in S25, YES in S31, and YES in S15).

When it is determined that an error has occurred in S23 or S29 (YES in S23 or YES in S29), the control unit 2A stops the head and ribbon drive and the RRS control (S35), and causes the process to proceed to S41. As illustrated in FIG. 6, when it is determined that an error has occurred, the controller 2A determines whether printing of the target column is incomplete, similarly to S7 (S41). When it is determined that printing of the target column is incomplete (YES in S41), the control unit 2A executes the reset control of the target column similarly to S9 (S43). When it is determined that printing of the target column is completed (YES in S41), or after execution of S43, the control unit 2A determines whether the error is released (S45). When it is determined that the error is not released (NO in S45), the control unit 2A returns the process to S45. When it is determined that the error is released (YES in S45), the control unit 2A returns the process to S1.

When the print resume command is received via the controller 7 after the start of execution of the print stop control (YES in S13), the control unit 2A executes print resume control that resumes the print operation control so that the bracket motor 62 is caused to resume the device position control from the stop position of the printing device 2, and the first motor 26 and the second motor 27 are caused to resume the ribbon transport control from the stop position of the ink ribbon 9A, and the thermal head 24 is caused to resume printing from the print interruption position of the ink ribbon 9A (YES in S19 and S21 to S31). In this embodiment, as an example of the print resume command, the print resume instruction input in the interruption state of the print operation control is illustrated. With this configuration, the printing device 2 can resume printing using the target column of the ink ribbon 9A continuously from the state before interruption of the print operation control.

Furthermore, when the print resume command and a first change command instructing change of at least one first parameter are received via the controller 7 after the start of execution of the print stop control (YES in S3 and NO in S5), the control unit 2A changes the at least one first parameter based on the first change command and resumes the print operation control (YES in S19 and S21 to S31). With this configuration, the printing device 2 can print the print image on the print medium P based on the setting information in which the first parameter is changed after the interruption of the print operation control is released.

When predetermined information is received via the controller 7 after the start of execution of the print stop control (YES in S3 and YES in S5), the control unit 2A resumes the print operation control (YES in S19 and S21 to S31) after executing the reset control of causing the bracket motor 62 to move the printing device 2 to the reference position and causing the first motor 26 and the second motor 27 to transport the ink ribbon 9A by a predetermined amount (S9). In this embodiment, as an example of receiving the predetermined information, a case where the setting change relating to the RRS control is performed is illustrated. With this configuration, the printing device 2 can switch the target column of the ink ribbon 9A to a new column and restart printing after the interruption of the print operation control is released.

Furthermore, when a second change command instructing change of at least one second parameter as the predetermined information is received via the controller 7 after the start of execution of the print stop control (YES in S3 and YES in S5), the control unit 2A changes the at least one second parameter based on the second change command, executes the reset control (S9), and then restarts the print operation control (YES in S19 and S21 to S31). With this configuration, the printing device 2 can print the print image on the print medium P based on the setting information in which the second parameter is changed after the interruption of the print operation control is released.

Specific Example of Print Operation

A specific example of the print operation based on the main process (see FIGS. 6 and 7) will be described with reference to FIG. 8. In the example illustrated in FIG. 8, a case where printing control of printing a print image of "ABC" for four blocks using one column of the ink ribbon 9A is repeated over a plurality of columns of the ink ribbon 9A is illustrated. After the print start instruction is received (YES in S13), the control unit 2A prints the print image of "ABC" for one block (S21 to S31) each time the print command is received (YES in S19).

Figure 8:
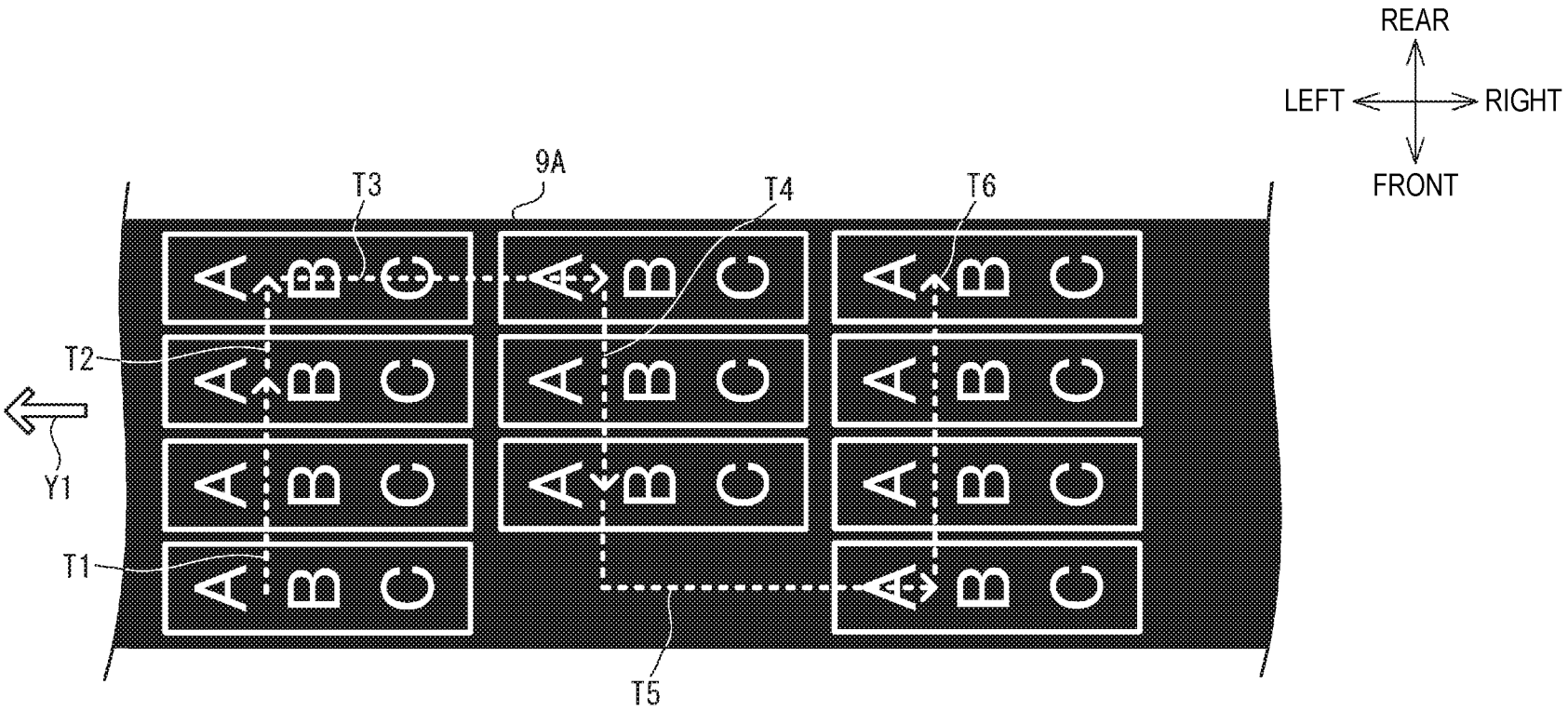
FIG. 8 is a diagram illustrating a specific example for explaining a flow of printing a plurality of blocks using an ink ribbon.

As illustrated in a state T1 of FIG. 8, first, the control unit 2A prints the print image of "ABC" for one block using the front-most unused area among four unused areas in the target column of the ink ribbon 9A. The control unit 2A moves the printing device 2 forward by the distance K by executing rearward preparation control each time printing for one block is completed (see FIG. 5). The control unit 2A executes printing for the next one block using the unused area in the rear of the used area E (see FIG. 5) of the target column of the ink ribbon 9A. With this configuration, the print images of "ABC" for a plurality of blocks are printed on the print medium P by being aligned in the width direction.

In this example, when printing for three blocks is performed in the state T1, the user inputs a print stop instruction (YES in S15). The user changes the setting information in a state where the standby state where printing is executable is released (YES in S3). The user changes the parameters of print density, print image length, print resolution, head temperature, and the like among the setting information. Since setting change of these parameters are not change relating to the RRS control (NO in S5), the control unit 2A does not execute the reset control of the target column.

Thereafter, when the user inputs the print start instruction (YES in S13), as illustrated in the state T2 of FIG. 8, the control unit 2A receives the print instruction (YES in S19) and resumes printing of the print image (S21 to S31). That is, the control unit 2A continues printing of the print image as it is from the state where the print operation is interrupted in the state T1. The control unit 2A completes printing for one block using the rear-most unused area among the four unused areas in the target column of the ink ribbon 9A. With this configuration, the print images of "ABC" for four blocks aligned in the width direction of the ink ribbon 9A are printed on the print medium P by being aligned in the width direction.

Next, as illustrated in a state T3 of FIG. 8, the control unit 2A executes the normal preparation control to switch the target column of the ink ribbon 9A to the next column upstream in the transport direction with respect to the column currently being printed (S27 to S31). Next, as illustrated in a state T4 of FIG. 8, the control unit 2A prints the print image of "ABC" for one block using the rear-most unused area among the four unused areas in the target column of the ink ribbon 9A. The control unit 2A moves the printing device 2 rearward by the distance K by executing the forward preparation control each time printing for one block is completed (see FIG. 4). The control unit 2A executes printing for the next one block using the unused area in front of the used area E of the target column of the ink ribbon 9A. With this configuration, the print images of "ABC" for a plurality of blocks are printed on the print medium P by being aligned in the width direction.

In this example, when printing for three blocks is performed in the state T4, the user inputs the print stop instruction (YES in S15). The user changes the setting information in a state where the standby state where printing is executable is released (YES in S3). The user changes parameters of the ribbon width, the RRS maximum number of rows, and the like among the setting information. Since setting change of these parameters are change relating to the RRS control (YES in S5). In the state T4, since the unused area remains in the target column of the ink ribbon 9A, printing of the target column is incompleted (YES in S7).

For that reason, the control unit 2A executes the reset control of the target example (S9). With this configuration, as illustrated in a state T5 of FIG. 8, the target column of the ink ribbon 9A is switched to the next column upstream in the transport direction with respect to the column currently being printed. The printing device 2 is moved to the reference position in the front-and-rear direction based on the reference position information stored in the storage unit 2B. That is, in the state T5, printing using the target column of the ink ribbon 9A is stopped, and the target column is switched to a new column.

Next, as illustrated in a state T6 of FIG. 8, the control unit 2A prints the print images of four blocks of "ABC" using four unused areas in the target column of the ink ribbon 9A in order from the front side. The process contents of the control unit 2A in the state T6 is the same as the process contents of the control unit 2A in the state T1.

Example of Operational Effect

According to the printing system 1 of this embodiment, the printing device 2 can be moved, and the ink ribbon 9A can be transported in the direction orthogonal to the moving direction of the printing device 2. When the control unit 2A receives the print command via the controller 7, the control unit 2A executes the print operation control (YES in S19 and S21 to S31). When the control unit 2A receives the print stop command via the controller 7, the control unit 2A executes the print stop control of releasing the standby state where printing is executable after the execution of the print operation control is completed (YES in S25, YES in S31, and YES in S15). When the control unit 2A receives the print resume command via the controller 7 after the start of execution of the print stop control, the control unit 2A executes print resume control that resumes the print operation control from the stop position of the printing device 2, the stop position of the ink ribbon 9A, and the print interruption position of the ink ribbon 9A (YES in S13, YES in S19, and S21 to S31). When the control unit 2A receives predetermined information via the controller 7 after the start of execution of print stop control, the control unit 2A restarts the print operation control after executing the reset control of moving the printing device 2 to the reference position and transporting the ink ribbon 9A by a predetermined amount (S9, YES in S19, and S21 to S31).

According to this, when the control unit 2A receives the print resume command via the controller 7 after the start of execution of the print stop control, the control unit 2A resumes the print operation control from the stop position of the printing device 2 in the print stop control, the stop position of the ink ribbon 9A, and the print interruption position of the ink ribbon 9A. In this case, since the print operation control resumes so as to continue from before the execution of the print stop control, it is possible to suppress waste of the ink ribbon 9A while suppressing the use marks of the ink ribbon 9A from overlapping. On the other hand, when the control unit 2A receives the predetermined information via the controller 7 after the start of execution of the print stop control, the control unit 2A restarts the print operation control after executing the reset control. In this case, since the next printing is started after feeding the ink ribbon 9A by a predetermined amount, the print operation control can be resumed while suppressing the use marks of the ink ribbon 9A from overlapping. Accordingly, the printing system 1 can suppress waste of the ink ribbon 9A while suppressing the use marks of the ink ribbon 9A from overlapping.

When the control unit 2A receives the print resume command and the first change command instructing change of at least one first parameter via the controller 7 after the start of the print stop control (YES in S3 and NO in S5), the control unit 2A changes the at least one first parameter based on the first change command, and executes the print resume control that resumes the print operation control (YES in S19 and S21 to S31). Accordingly, the control unit 2A can execute printing using the ink ribbon 9A based on the changed first parameters relating to, for example, the print density, the print image length, the print resolution, and the head temperature. The at least one first parameter may include a parameter of print density of an image to be printed by the thermal head 24 using the ink ribbon 9A.

Furthermore, when the control unit 2A receives the second change command instructing change of at least one second parameter as predetermined information via the controller 7 after the start of execution of the print stop control (YES in S3 and YES in S5), the control unit 2A changes the at least one second parameter based on the second change command, executes the reset control, and then restarts the print operation control (S9, YES in S19, and S21 to S31). Accordingly, the control unit 2A can execute printing using the ink ribbon 9A based on the changed second parameter relating to, for example, the ribbon width and the RRS maximum number of rows. The at least one second parameter may include the parameter of the maximum number of columns, which is the maximum number of the plurality of images to be printed aligned in the width direction of the ink ribbon 9A by the thermal head 24.

Others

In the embodiment described above, the control units 2A and 7A are examples of the "control unit" in this disclosure. The controller 7 is an example of the "interface" of this disclosure. The bracket motor 62 is an example of the "device moving unit" in this disclosure. The first motor 26 and the second motor 27 are examples of the "ribbon transport portion" in this disclosure. This disclosure is not limited to the embodiment described above, and various modifications may be made thereto.

The printing system 1 may include the printing device 2, the control units 2A and 7A, the controller 7, and the bracket motor 62, and the configuration thereof may be changed as appropriate. For example, the printing device 2 may include a medium transport device that transports the print medium P, or may include the platen roller Q. The printing device 2 may be a type of thermal printer in which printing is performed by stopping transport of the ink ribbon 9A and the print medium P at the time of printing and moving the thermal head 24 along the ink ribbon 9A.

In the printing system 1, when the printing device 2 is connected to the external apparatus 8 without passing through the controller 7, the controller 7 may not be provided. In this case, the control unit 2A of the printing device 2 may execute the process for which the control unit 7A of the controller 7 is responsible. In the printing system 1, when the control unit 7A of the controller 7 can execute the process for which the control unit 2A of the printing device 2 is responsible, the control unit 2A of the printing device 2 may not be provided.

In the embodiment described above, the control unit 2A of the printing device 2 executes the main process (see FIGS. 6 and 7), but the control unit 7A of the controller 7 may execute a part or all of the main process. For example, the control unit 7A may execute the setting change and the process relating to the reset control accompanying the setting change (S3 to S9), in the main process.

The external apparatus 8 is not limited to the medium transport device that transports the print medium P, and may be an external terminal such as a PC that allows the user to operate the printing device 2. Instead of this, the printing system 1 may include the external terminal such as the PC which allows the user to operate the printing device 2 separately from the external apparatus 8. In this case, the external terminal is preferably connected to the printing device 2 via the controller 7 similarly to the external apparatus 8. When the user inputs the setting information change instruction, the print start instruction, the print stop instruction, and the like from the external terminal, the controller 7 may output the input various instructions to the printing device 2. When the printing device 2 includes an operation unit, the user may input the setting information change instruction, the print start instruction, the print stop instruction, and the like from the operation unit of the printing device 2 to the control unit 2A.

In the embodiment described above, when the second parameter of ribbon width, RRS maximum number of columns, or the like is changed, the control unit 2A determines that the setting change relating to the RRS control is performed (YES in S5). Instead of this, even in a case where the second parameter is changed, when it is not necessary to change the current RRS control, the control unit 2A may determine that the setting change relating to the RRS control is not performed (NO in S5). Even in a case where the second parameter is changed, for example, when there is no change in the number of images to be printed using the moving distance K during the RRS control or the target column of the ink ribbon 9A, it is not necessary to change the current RRS control. Accordingly, the control unit 2A can omit the reset control (S9) by determining that the setting change relating to the RRS control is not performed.

What is claimed is:

1. A printing system comprising:

a movable printing device;

a control unit;

an interface; and a device moving unit that is configured to move the movable printing device, wherein the movable printing device includes a thermal head and a ribbon transport unit that is configured to transport an ink ribbon in a direction orthogonal to a moving direction of the movable printing device, wherein the control unit is configured to:

execute, when a print command is received via the interface, print operation control including: device position control of causing the device moving unit to move the movable printing device and positioning the movable printing device in a width direction of a print medium; ribbon transport control of causing the ribbon transport unit to transport the ink ribbon and transporting the ink ribbon between the print medium and the thermal head in a length direction of the print medium; and head print control of causing the thermal head to heat the ink ribbon being transported and executing printing on the print medium;

execute, when a print stop command is received via the interface, print stop control of releasing a standby state where printing is executable after execution of the print operation control is completed;

execute, when a print resume command is received via the interface after a start of execution of the print stop control, print resume control of: causing the device moving unit to resume the device position control from a stop position of the movable printing device; causing the ribbon transport unit to resume the ribbon transport control from a stop position of the ink ribbon; and causing the thermal head to resume printing from a print interruption position of the ink ribbon, and execute, when predetermined information is received via the interface after the start of execution of the print stop control, reset control of causing the device moving unit to move the movable printing device to a reference position, causing the ribbon transport unit to transport the ink ribbon by a predetermined amount and then restarting the print operation control.

2. The printing system according to claim 1, wherein the control unit is configured to execute the print operation control based on a first parameter and a second parameter, for the first parameter the reset control is not needed, and when the print resume command and a first change command instructing change of the first parameter are received via the interface after the start of execution of the print stop control, the control unit is configured to change the first parameter based on the first change command and execute the print resume control to resume the print operation control.

3. The printing system according to claim 2, wherein the first parameter includes a parameter of print density of an image to be printed with the thermal head using the ink ribbon.

4. The printing system according to claim 1, wherein the control unit is configured to execute the print operation control based on a first parameter and a second parameter, for the second parameter the reset control is needed, when a second change command instructing change of the second parameter is received as the predetermined information via the interface after the start of execution of the print stop control, the control unit is configured to change the second parameter based on the second change command and execute the reset control to restart the print operation control.

5. The printing system according to claim 4, wherein the second parameter includes a parameter of the maximum number of columns, which is the maximum number of a plurality of images to be printed aligned in a width direction of the ink ribbon with the thermal head.

* * * * *